US011767156B1

(12) United States Patent
Salmon et al.

(10) Patent No.: US 11,767,156 B1
(45) Date of Patent: Sep. 26, 2023

(54) BEVERAGE INSULATING DEVICES

(71) Applicant: PUFFIN COOLERS LLC, Bend, OR (US)

(72) Inventors: Michael C. Salmon, Bend, OR (US); Byron Jay Linton, Jr., Bend, OR (US); Tyrone Hugh Hazen, Bend, OR (US)

(73) Assignee: Puffin Coolers LLC, Bend, OR (US)

( * ) Notice: Subject to any disclaimer, the term of this patent is extended or adjusted under 35 U.S.C. 154(b) by 0 days.

(21) Appl. No.: 18/100,391

(22) Filed: Jan. 23, 2023

(51) Int. Cl.
*B65D 81/38* (2006.01)
*A47G 23/02* (2006.01)

(52) U.S. Cl.
CPC ..... *B65D 81/3886* (2013.01); *A47G 23/0216* (2013.01)

(58) Field of Classification Search
CPC ..... B65D 81/3886; A47G 23/0216
USPC ..... 215/12.1, 395, 11.6, 13.1, 386; 220/903, 220/739, 592.14, 737, 626; 224/148.3, 224/628, 242; 383/110, 97, 66, 74, 95, 383/99, 86, 121.1; D7/625, 605–607, D7/624.2–624.3, 619.2
See application file for complete search history.

(56) References Cited

U.S. PATENT DOCUMENTS 1,895,278 A * 1/1933 Wilbur ..... B65D 81/3897 383/110
1,922,485 A * 8/1933 McKee ..... B65D 81/3886 383/110
1,949,677 A * 3/1934 Wllbur ..... B65D 81/3886 383/110
2,376,194 A * 5/1945 Samuels ..... B65D 65/08 D3/202
2,865,421 A * 12/1958 Walsh ..... A45C 7/0077 383/29
4,197,890 A * 4/1980 Simko ..... F25D 31/007 383/110
4,401,245 A * 8/1983 Zills ..... B65D 81/3886 224/148.6
D290,922 S * 7/1987 Herrera ..... D21/805
4,802,602 A * 2/1989 Evans ..... B65D 81/3886 224/675
4,871,597 A * 10/1989 Hobson ..... B32B 27/065 220/903
4,988,216 A * 1/1991 Lyman ..... A45C 11/20 383/110
D335,614 S * 5/1993 Diab ..... D21/805
5,518,315 A * 5/1996 Nichols ..... A45C 13/36 383/18

(Continued)

*Primary Examiner* — J. Gregory Pickett
*Assistant Examiner* — Brijesh V. Patel
(74) *Attorney, Agent, or Firm* — Leber IP Law; Celia H. Leber

(57) ABSTRACT

Insulating devices are disclosed that are designed to hold a beverage container, such as a can or a plastic or glass bottle. The devices include a body designed to maintain the temperature of the contents of the container and a base mounted on the body. The base includes an exposed surface configured to prevent sliding of the device on a surface on which the device is placed. The base may also be configured to enhance the stiffness of the lower part of the body and may improve the insulating characteristics of the device, for example, if the device is placed on a surface having a temperature that is significantly hotter or colder than the air temperature.

19 Claims, 8 Drawing Sheets

(56) References Cited

U.S. PATENT DOCUMENTS 5,676,295 A * 10/1997 Gelb ..... A45F 3/04 224/628
5,848,734 A * 12/1998 Melk ..... A47J 41/0027 383/110
D404,564 S * 1/1999 Rausch ..... D3/229
5,915,580 A * 6/1999 Melk ..... B65D 81/3886 220/592.24
6,073,796 A * 6/2000 Mogil ..... B65D 81/3886 220/592.24
6,401,993 B1 * 6/2002 Andrino ..... A45F 5/00 D3/229
D481,267 S * 10/2003 Yamane ..... D7/625
D482,242 S * 11/2003 Yamane ..... D7/625
D482,243 S * 11/2003 Yamane ..... D7/625
D482,244 S * 11/2003 Yamane ..... D7/625
D484,366 S * 12/2003 Yamane ..... D7/625
D489,229 S * 5/2004 Yamane ..... D7/625
D494,423 S * 8/2004 Wright ..... D7/625
6,814,252 B2 * 11/2004 Murakami ..... B65D 81/3876 220/739
6,866,159 B2 * 3/2005 Yamane ..... B65D 25/22 215/400
7,124,604 B2 * 10/2006 Taylor ..... A47G 23/0313 62/530
D567,031 S * 4/2008 Zacharias ..... B65D 81/3879 D7/624.3
7,712,625 B2 * 5/2010 Alger ..... A47G 23/0313 220/666
D688,102 S * 8/2013 Chu ..... A61J 9/0684 D7/625
D696,858 S * 1/2014 Kowalsky ..... D3/229
D738,727 S * 9/2015 McConnell ..... A47G 23/0241 D9/499
D760,549 S * 7/2016 Haytayan ..... D7/624.1
D796,270 S * 9/2017 McConnell ..... F25D 3/08 D7/625
10,173,827 B1 * 1/2019 Foote, Jr. ..... A47G 23/0241
D849,483 S * 5/2019 Watson ..... A47G 23/0313 D7/515
D880,255 S * 4/2020 Randall ..... F25D 3/08 D7/624.2
10,750,892 B1 * 8/2020 Wegner ..... F25D 3/08
11,505,395 B2 11/2022 Hazen
2007/0012593 A1 * 1/2007 Kitchens ..... A45C 7/0036 206/545
2013/0020223 A1 * 1/2013 White ..... B65D 81/3879 220/737
2013/0152622 A1 * 6/2013 Reisig ..... F25D 3/08 62/457.4
2017/0071829 A1 * 3/2017 Plavan ..... A61J 9/0684

* cited by examiner

BEVERAGE INSULATING DEVICES

BACKGROUND

Soft-sided, fabric beverage insulating devices are disclosed in U.S. Pat. No. 11,505,395, the full disclosure of which is incorporated by reference herein, and sold commercially by Puffin Drinkwear. These beverage insulating devices are designed as miniature versions of outerwear apparel, such as sweaters, jackets, and vests, as well as a miniature sleeping bag. The bottom surface of these insulating devices, which rests on a surface (e.g., a table or the ground) when the device is not being held by a user, is formed of the same fabric as the outer side walls of the device. As disclosed in U.S. Pat. No. 11,505,395, a stiffener is generally provided within the base of the insulating device, positioned between layers of material that together form the base.

SUMMARY

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The invention described herein features a beverage container insulating device, comprising: a soft-sided generally cylindrical body having an upper end configured to receive a beverage container, a central area configured to surround and insulate the container during use, and an open lower end, and a polymeric base joined to the open lower end to close the lower end, the polymeric base having an exposed bottom surface.

In one embodiment, the beverage container insulating device body is formed of an inner fabric layer, an outer fabric layer, and an insulating layer disposed between the inner and outer fabric layers.

In another embodiment, the polymeric base comprises an elastomeric material.

In one embodiment, the polymeric base comprises a central disc and a rim extending upwards from a perimeter of the disc.

In one embodiment, the open lower end of the body is fastened to the rim of the polymeric base.

In one embodiment, the polymeric base is formed of a material selected from the group consisting of thermoplastic elastomers, thermoplastic polyurethanes, thermoset polymers, thermoplastic rubbers, silicones, natural rubber, and combinations thereof.

In one embodiment, the polymeric base comprises a thermoplastic elastomer.

Optionally, the polymeric base is formed of a moldable ethylene vinyl acetate (EVA) foam.

In one embodiment, the polymeric base is formed of a material having a durometer of from about 30 to 90 Shore A.

In another embodiment, the polymeric base is formed of the material having the durometer of from about 40 to 55 Shore A.

In one embodiment, the disc of the polymeric base has a convex region having a radius of curvature of about 1 to 10 mm.

In one embodiment, the rim of the polymeric base is covered by the body.

In one embodiment, the disk of the polymeric base has a thickness of about 2.5 to 10 mm.

In another embodiment, the rim of the polymeric base has a thickness of about 1 to 10 mm.

The invention described here provides a method of making a beverage container insulating device, comprising the steps of: providing a soft-sided generally cylindrical body having an upper end configured to receive a beverage container, a central area configured to surround and insulate the container during use, and an open lower end, a polymeric base having an exposed bottom surface, and joining the polymeric base along the periphery to the open lower end of the cylindrical body to close the lower end.

In another aspect, the invention described herein features a method of using a beverage container insulating device, comprising the steps of: providing a soft-sided generally cylindrical body having an upper end configured to receive a beverage container, a central area configured to surround and insulate the container during use, and an open lower end, a polymeric base joined to the open lower end to close the lower end, the polymeric base having an exposed bottom surface, and inserting the beverage container through the upper end to keep cool the content of the container.

Various other objects, features, and advantages of the invention will become apparent to those ordinarily skilled in the art upon review of the following description of specific embodiments of the invention in conjunction with the accompanying figures.

DETAILED DESCRIPTION

The present disclosure features insulating devices that are designed to hold a beverage container, such as a can or a plastic or glass bottle. The devices include a body designed to maintain the temperature of the contents of the container and a base mounted on the body. As will be discussed in further detail below, the base includes an exposed surface configured to prevent sliding of the device on a surface on which the device is placed. The base also generally enhances the stiffness of the lower part of the body and may improve the insulating characteristics of the device, for example, if the device is placed on a surface having a temperature that is significantly hotter or colder than the air temperature. One implementation of the devices disclosed herein is shown in FIGS. 1-7.

Figure 1:
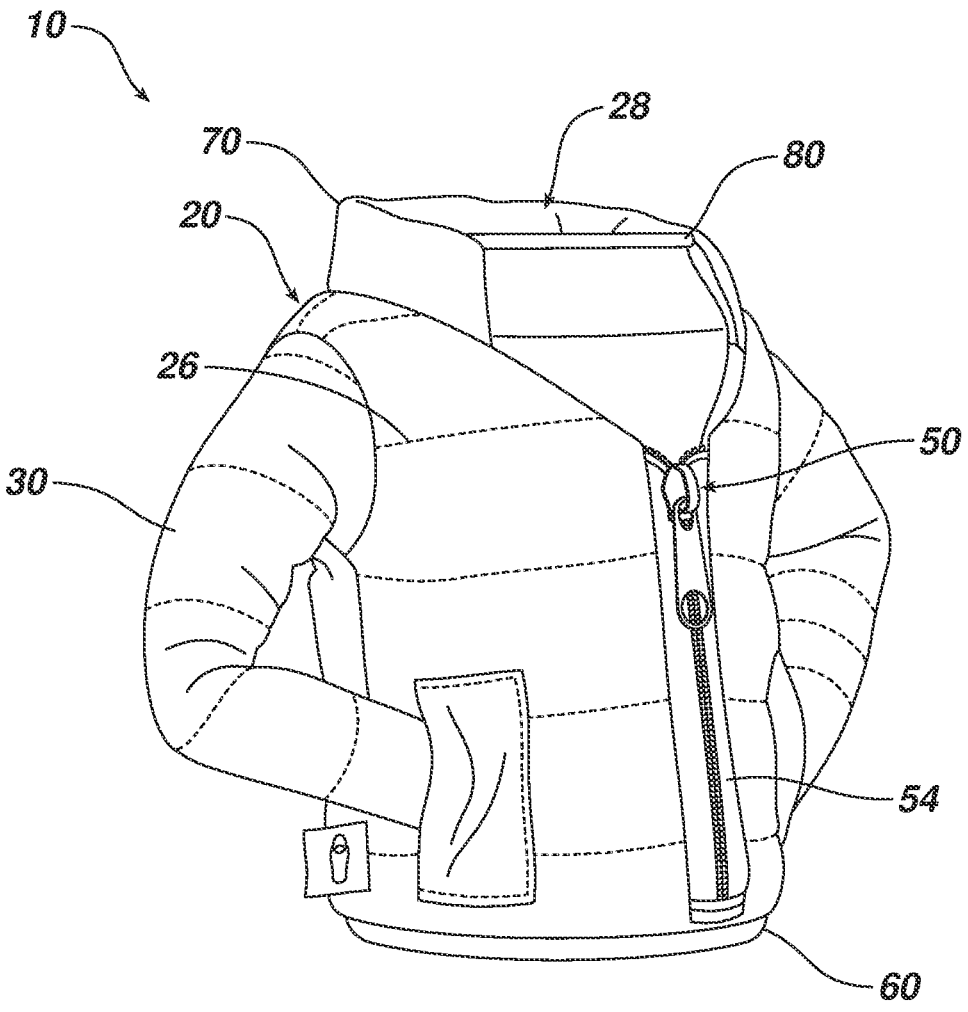
FIG. 1 is a perspective front view of a beverage insulating device according to one implementation, with a beverage can disposed within the body of the device.
Figure 1A:
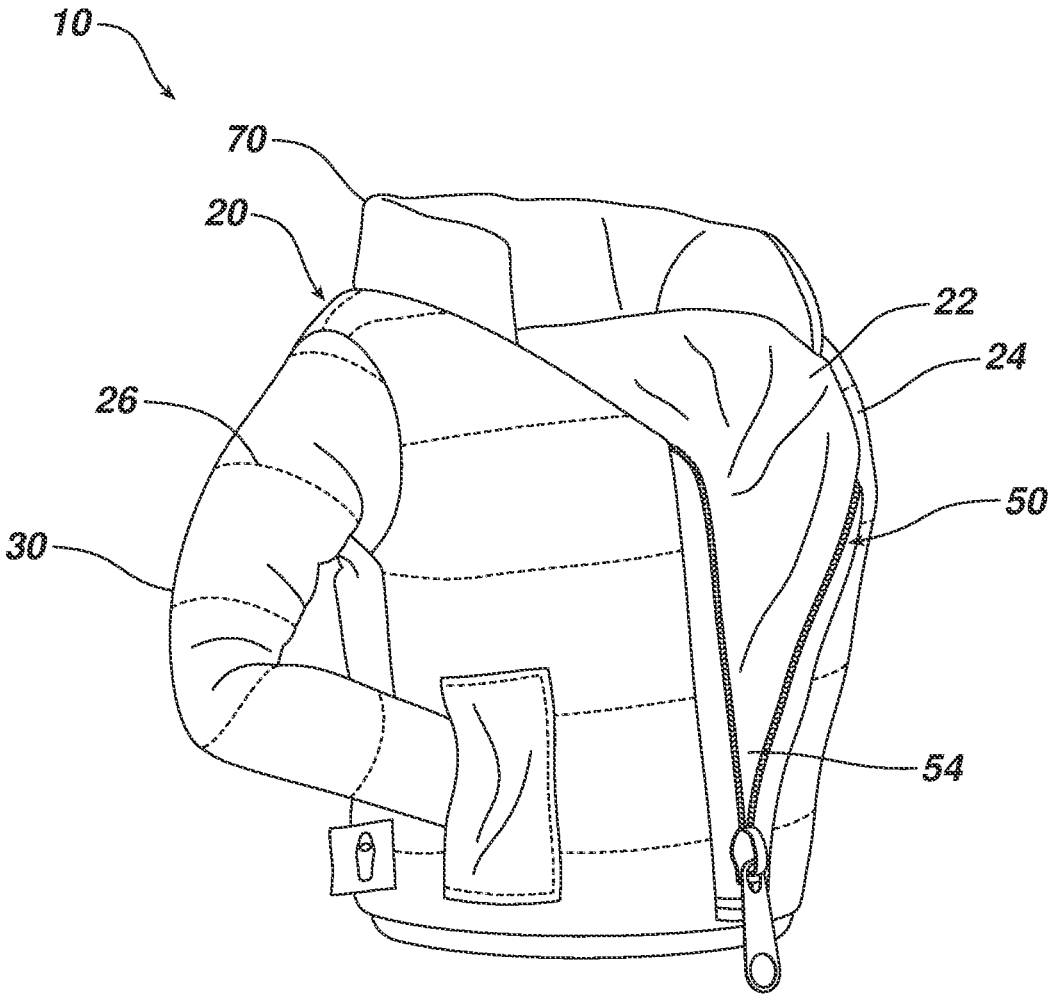
FIG. 1A is a perspective front view of the beverage insulating device shown in FIG. 1, with the beverage can removed.
Figure 2:
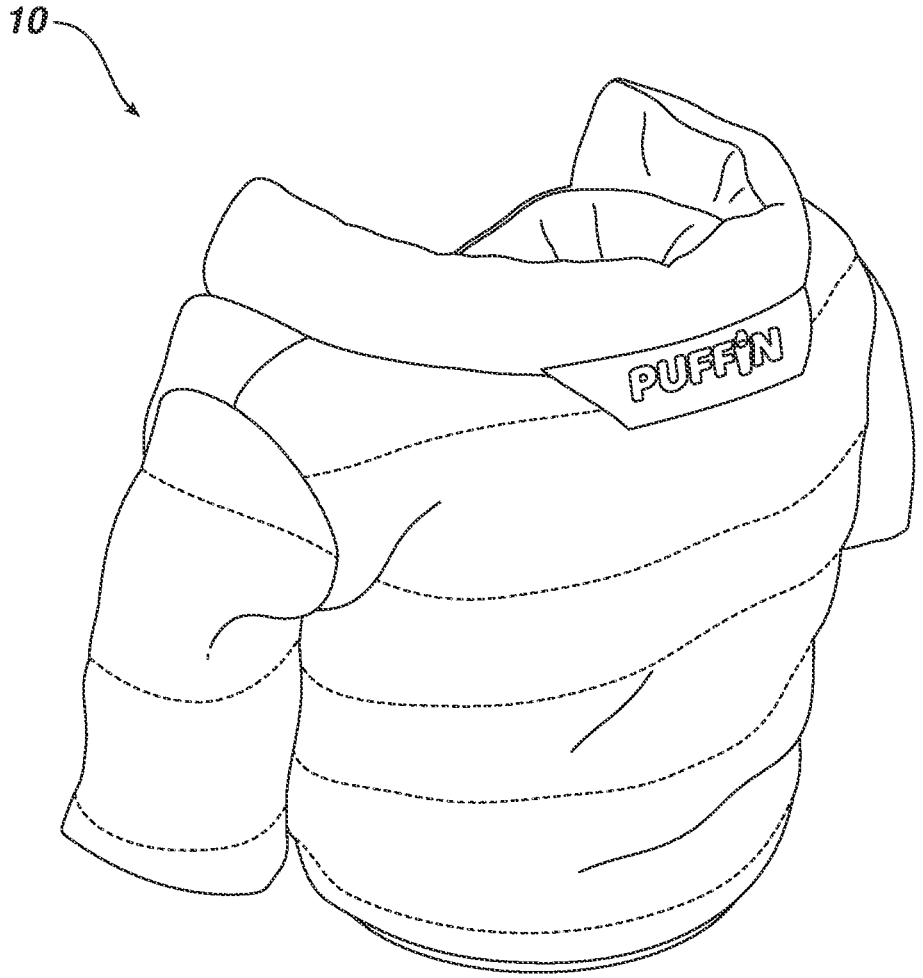
FIG. 2 is a perspective back view of the beverage insulating device shown in FIG. 1.
Figure 3:
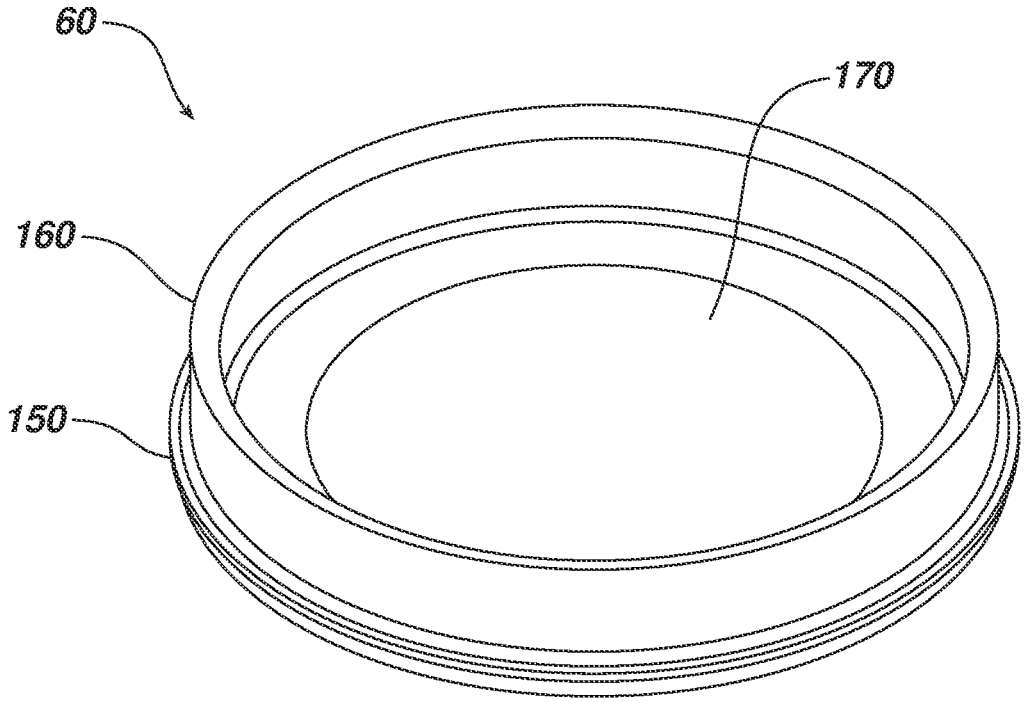
FIG. 3 is a perspective top view of a base for the beverage insulating device shown in FIG. 1.

Referring to FIGS. 1 and 1A, insulating device 10 includes a body 20, which in the illustrated embodiment is in the form of a miniature jacket having a collar 70, and sleeves 30, wherein the open end of the sleeves are stitched inside the pockets. The body 20 of the insulating device has an inner wall 22 (FIG. 1A) formed of a liner fabric 280 (shown also in FIG. 5) and an outer wall 24 formed of an outer fabric 260 (FIG. 5), as described below. The term "fabric," as used herein, includes woven and nonwoven fabrics and other fabric-like sheet materials.

Figure 5:
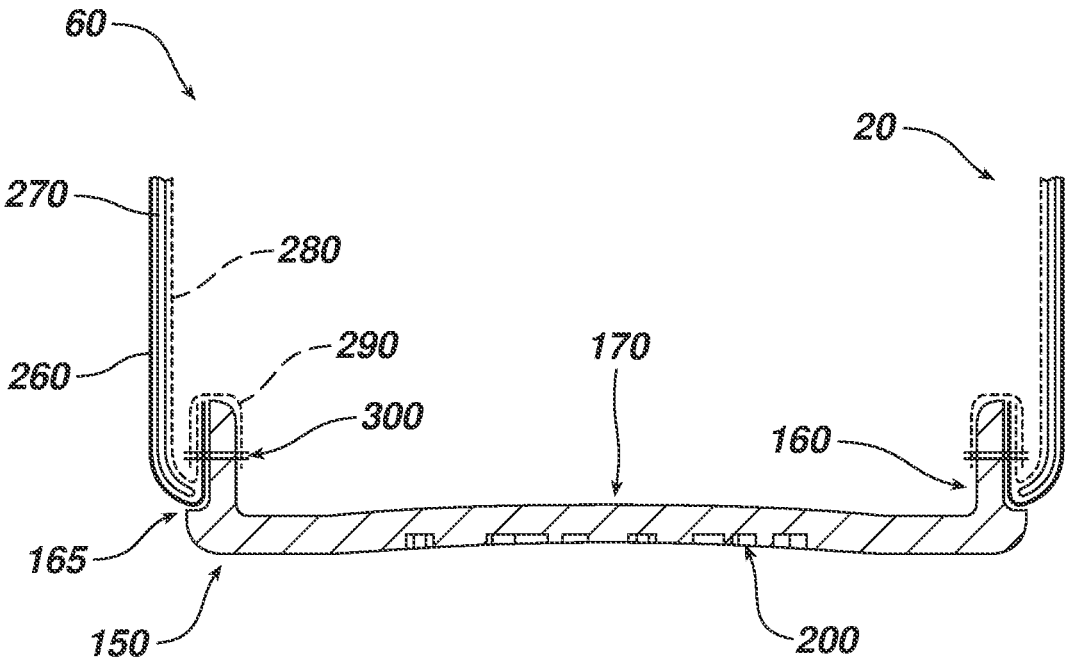
FIG. 5 is a cross-sectional view of a lower portion of the insulating device of FIG. 1, showing the attachment of the base to a bottom edge of the body.

The inner wall 22 and outer wall 24 are fastened together by stitching at plural fastening locations 26 that extend transverse to the vertical axis of the body, with a batting or insulating material 270 (FIG. 5) disposed between the inner and outer walls. The transverse stitching is configured in a manner similar to the stitching of a down jacket or other insulated jacket. The body 20 has an open top 28 and a lower portion in the form of a tube having an open bottom (FIG. 5). A lower edge of the open bottom is attached to a base 60 that closes the bottom of the device, as will be discussed in detail below.

In the implementation shown in FIGS. 1-1A, the body 20 also has a zipper 50 that closes a vertical slit 54 in the body. The zipper 50 functions to selectively open and close the vertical slit 54 in body 20, facilitating insertion and removal of a container 80. Buttons or hook and loop closures may also be utilized in addition to or in place of the zipper 50 for the same purpose.

FIGS. 3-7 show an example of a base 60 for the beverage insulating device, which is used to close the bottom end of the body 20, to support the container 80, and to provide the device with an exposed bottom surface that contacts a surface on which the device is placed. The base is configured to provide a degree of rigidity to the bottom of the device, facilitating the insertion of a container into the body and providing a flat, stable surface for the device to rest on when placed on a supporting surface such as a table or the ground.

Figure 7:
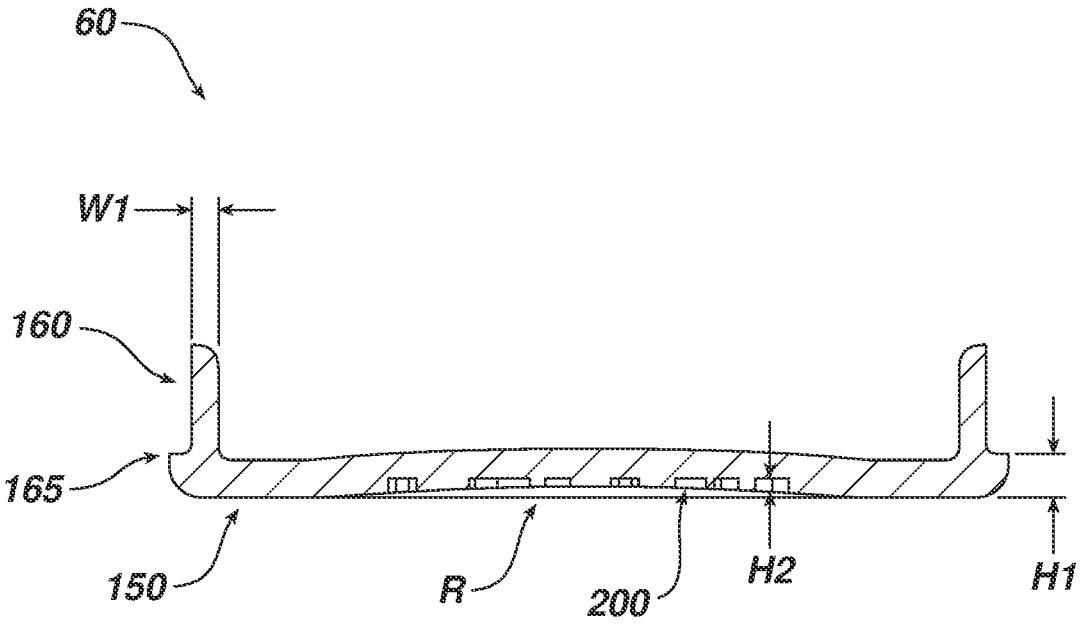
FIG. 7 is a cross-sectional view of the base, taken along line A-A in FIG. 6.

The base 60 includes a central disc 150 surrounded by a vertical rim 160 that extends upward from the disc 150. The central part 170 of the disk may be curved up, as shown in FIGS. 5 and 7, to provide a slight concavity to the bottom surface 190 of the disc. This feature, when included, tends to increase the stiffness of the base. The radius of curvature R (FIG. 7) of the concavity may be from about 20 cm to 30 cm, more preferably 23 cm to 28 cm. The distance from a supporting surface to the apex of the concave area is 12.7 mm with a range of 7.6 mm to 17.8 mm. The corresponding convexity of the upper surface of the disc also allows the base to conform to the lower surface of some containers, for example, aluminum beverage cans.

The diameter of the base is selected to be slightly larger than the diameter of the container that the product is designed to be used with. The thickness of the base (H1 in FIG. 7) is selected to provide a balance of structural stability and flexibility, and may be, for example, from about 2.5 mm to 10 mm, e.g., about 4 to 6 mm.

Figure 4:
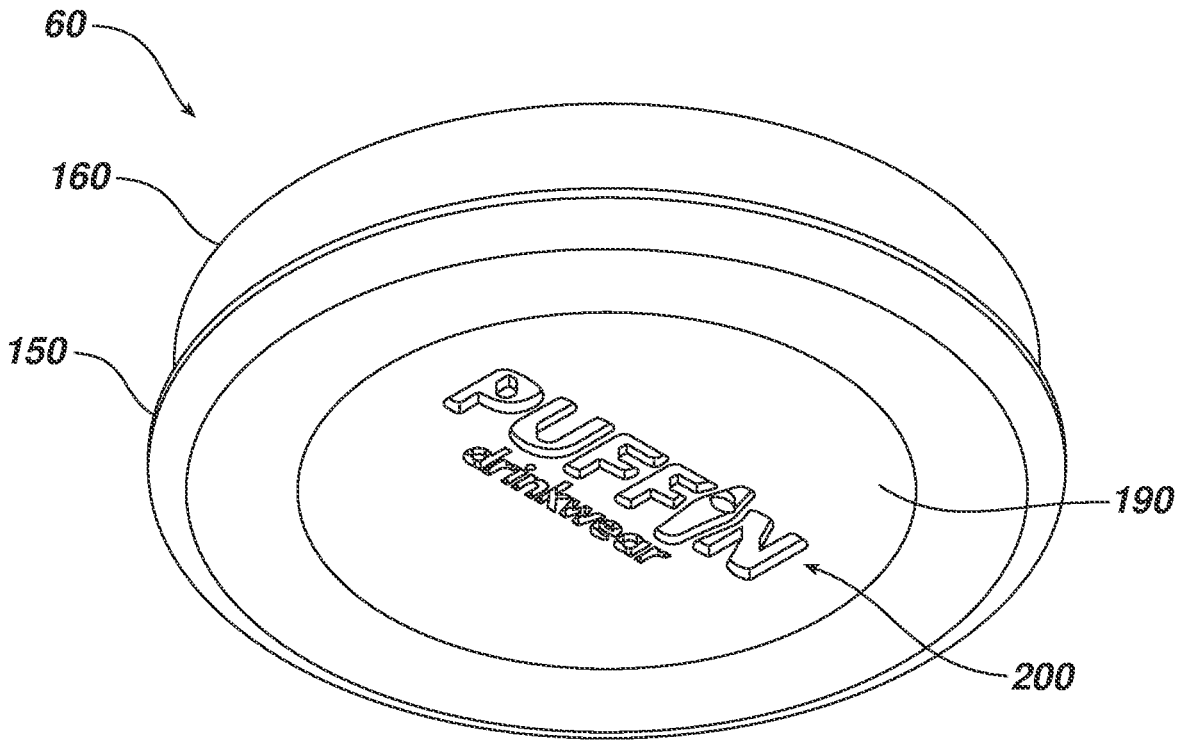
FIG. 4 is a perspective bottom view of the base shown in FIG. 3.
Figure 6:
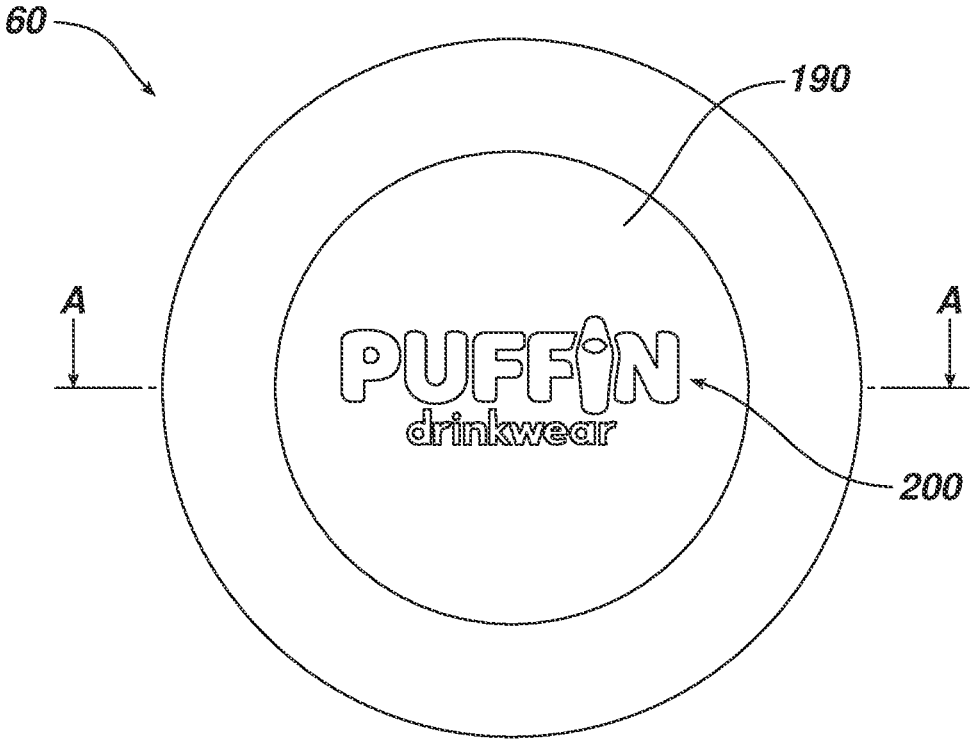
FIG. 6 is a bottom plan view of the base.

FIGS. 4 and 6 show bottom views of the base 60 for the beverage insulating device 10. The base 60 has an exposed (i.e., not covered with fabric) bottom surface 190 that is preferably formed of a non-slip material to minimize slipping or sliding of the base when placed on a smooth surface. Surface 190 of the base may include a logo 200 in a central region of the disk 150 and/or additional declarative writings, artwork, or other indicia around an outer region of the disk. These indicia may be recessed, as shown, which may increase the slip resistance of the bottom surface 190. For example, as shown in FIG. 7, the logo may be recessed to a depth H2 of from about 1 to 2 mm, e.g., about 1.2 to 1.8 mm.

In addition, to slip resistance, it is desirable that the base 60 be relatively soft and flexible, for example, to allow the base to bend if the device is to be squeezed into a backpack or pocket, and to meet aesthetic/tactile design criteria. The base 60 is preferably formed of a polymeric material, for example, an elastomeric material. Suitable elastomeric materials include, for example, silicones, blends of thermoplastic elastomer (TPE) and silicone, thermoplastic polyurethanes (TPUs), thermoplastic rubbers (TPRs), thermoset rubbers, natural rubber, moldable ethylene vinyl acetate (EVA) foam, and combinations thereof. TPR has the characteristics of both rubber and plastic. The hardness of the polymeric material of the base is selected to provide a balance of stiffness, to enhance the structural stability of the lower portion of the device, and softness for slip resistance and foldability. In some implementations, the material of the base has a durometer of from about 30 to 90 Shore A, 40 to 80 Shore A, or 50 to 70 Shore A, most preferably about 40 to 55 Shore A.

Referring to FIG. 5, as discussed above, the body 20 includes three fabric layers, an outer fabric 260, a liner fabric 280, and an insulating layer 270 interposed between the outer fabric and inner fabric.

The outer fabric may be any desired type of fabric, for example, decorative fabrics that are the same as or resemble the fabrics used in outerwear (jackets, sweaters, and the like). The fabric may possess insulating properties.

The inner fabric may be selected to enhance the insulating characteristics of the device, for example, by providing cold-retention. Suitable materials include the silver foil thermos-liner materials used in soft coolers. Metallic polyurethane coated polyester fabric is useful to insulate as well as provide durability.

In some implementations, the insulating layer 270 is a layer of batting material. Other suitable insulating materials include gels, beads, or foams. In addition to insulation, the insulating layer may be configured to provide other benefits, such as protection against impact or active temperature modification.

FIG. 5 also shows how the base may be attached to the body to form the insulating device. In the implementation shown, a lower edge of the body 20 is attached to the vertical rim 160 of the base by stitching. Stitches 300 pass through a binding material 290, the vertical rim 160, the outer fabric 260, and the liner fabric 280. The stitches 300 do not traverse through the batting 270. The outer fabric 260 and liner fabric 280 are folded upward against the outer surface of the rim 160, as shown in FIG. 5, to provide a smooth lower edge abutting the base rather than the raw edges of the fabric layers. As can be seen, for example, in FIGS. 3, 5, and 7, the rim 160 is slightly inboard of the edge of the disc 150, providing a shoulder 165 against which the folded lower edges are positioned. The binding material is wrapped over the outer fabric and inner fabric layers and the upper edge of the rim 160 to enhance the security of the attachment. The wall thickness of the rim W1 is selected to be thin enough to allow the rim to be penetrated by a sewing machine needle without requiring excessive force while having sufficient thickness for the stitching to provide a secure connection between the base and body. In some implementations, the rim has a thickness W1 (FIG. 7) of about 1 to 10 mm, e.g., about 2.5 to 7.5 mm. Binding stitches 300 are 4-5 mm in length to provide a solid connection with out over-perforating the rubber base to avoid a tear. The binding material is used to aesthetically close off the open ends of the body panels and their union to the base. The binding material may be, for example, the same material as the outer fabric 260 material or the liner fabric 280.

Other Embodiments

A number of embodiments have been described. Nevertheless, it will be understood that various modifications may be made without departing from the spirit and scope of the disclosure.

For example, in addition to the layers of the body discussed above, a wicking layer can be added to keep the container cool for extended periods of time. For example, as the internal and ambient temperatures begin to match, the container sweating inside the device can have the sweat wicked to the surface and evaporate, aiding in cooling the container and maintaining the liquid content at a cooler temperature for a longer period.

Moreover, while the device shown in the drawings includes a central slit that is closed by a zipper, in other embodiments, devices can have other arrangements, such as including a slit that is offset from the centerline or a slit that extends only partly down the longitudinal axis of the device (e.g., resembling the opening of a shirt collar), or the slit may be omitted entirely. Also, as noted above, instead of a zipper, other fasteners may be used, or if the slit does not extend the length of the longitudinal axis, in some cases, fasteners may be omitted.

In addition, while the rim of the base is shown in FIG. 5 as being stitched to the liner fabric, body fabric, and binding, other configurations are possible, for example, stitching through the batting and/or omitting the binding, or adhering the base to the cylindrical body using a glue.

Accordingly, other embodiments are within the scope of the following claims.

What is claimed is:

1. A beverage container insulating device, comprising:

a soft-sided generally cylindrical body having an upper end configured to receive the beverage container, a central area configured to surround and insulate the beverage container during use, and an open lower end, and a polymeric base joined to the open lower end to close the open lower end, the polymeric base having an exposed bottom surface, wherein the polymeric base comprises a central disc and a rim extending upwards from a perimeter of the disc, and the open lower end is joined to an outer surface of the rim.

2. The beverage container insulating device of claim 1, wherein the cylindrical body is formed of an inner fabric layer, an outer fabric layer, and an insulating layer disposed between the inner and the outer fabric layers.

3. The beverage container insulating device of claim 1, wherein the polymeric base comprises an elastomeric material.

4. The beverage container insulating device of claim 1, wherein the polymeric base is formed of a material selected from the group consisting of thermoplastic elastomers, thermoplastic polyurethanes, thermoset polymers, thermoplastic rubbers, silicones, natural rubber, and combinations thereof.

5. The beverage container insulating device of claim 4, wherein the polymeric base comprises a thermoplastic elastomer.

6. The beverage container insulating device of claim 4, wherein the polymeric base is formed of a moldable ethylene vinyl acetate (EVA) foam.

7. The beverage container insulating device of claim 1, wherein the polymeric base is formed of a material having a durometer of from about 30 to 90 Shore A.

8. The beverage container insulating device of claim 1, wherein the polymeric base is formed of the material having the durometer of from about 40 to 55 Shore A.

9. The beverage container insulating device of claim 1, wherein the disc of the polymeric base has a convex region having a radius of curvature of about 10 to 10 mm.

10. The beverage container insulating device of claim 1, wherein the rim of the polymeric base is covered by the cylindrical body.

11. The beverage container insulating device of claim 1, wherein the disc of the polymeric base has a thickness of about 2.5 to 10 mm.

12. The beverage container insulating device of claim 1, wherein the rim of the polymeric base has a thickness of about 1 to 10 mm.

13. The beverage container insulating device of claim 1, wherein the polymeric base consists of a single layer of elastomeric material.

14. The beverage container insulating device of claim 1, wherein the polymeric base includes a shoulder extending outboard of the rim around the perimeter of the polymeric base.

15. The beverage container insulating device of claim 14, wherein a folded surface of the cylindrical body adjacent the open lower end contacts the shoulder providing a smooth lower edge abutting the polymeric base.

16. The beverage container insulating device of claim 15, wherein a portion of the cylindrical body between the folded surface and the open lower end is folded upward to contact the outer surface of the rim.

17. A beverage container insulating device, comprising:

a soft-sided generally cylindrical body having an upper end configured to receive a beverage container, a central area configured to surround and insulate the beverage container during use, and an open lower end, and a polymeric base joined to the open lower end to close the open lower end, the polymeric base comprising an elastomeric material;

wherein the polymeric base comprises a central disc and a rim extending upwards from a perimeter of the disc, and the open lower end is joined to an outer surface of the rim.

18. A method of making a beverage container insulating device, comprising the steps of:

providing a soft-sided generally cylindrical body having an upper end configured to receive a beverage container, a central area configured to surround and insulate the container during use, and an open lower end, a polymeric base having an exposed bottom surface and including a central disc and a rim extending upwards from a perimeter of the disc, and joining the open lower end of the cylindrical body to an outer surface of the rim the close the open lower end.

19. A method of using a beverage container insulating device, comprising the steps of:

providing a soft-sided generally cylindrical body having an upper end configured to receive a beverage container, a central area configured to surround and insulate the beverage container during use, and an open lower end, a polymeric base having an exposed bottom surface and including a central disc and a rim extending upwards from a perimeter of the disc, wherein the open lower end is joined to an outer surface of the rim to close the open lower end, and inserting the beverage container through the upper end to keep cool the contents the contents of the beverage container.

* * * * *